United States Patent [19]

Dahnert

[11] Patent Number: 4,947,161

[45] Date of Patent: Aug. 7, 1990

[54] LIGHT BAR

[75] Inventor: Dean L. Dahnert, Fort Atkinson, Wis.

[73] Assignee: White Consolidated Industries, Inc., Cleveland, Ohio

[21] Appl. No.: 302,784

[22] Filed: Jan. 30, 1989

Related U.S. Application Data

[62] Division of Ser. No. 931,184, Nov. 17, 1986, Pat. No. 4,810,044.

[51] Int. Cl.[5] ..... G09G 3/14

[52] U.S. Cl. ..... 340/815.03; 340/782; 361/397

[58] Field of Search ..... 340/815.03, 762, 782, 340/715; 312/223; 361/395, 397

[56] References Cited

U.S. PATENT DOCUMENTS

| | | | |
|---|---|---|---|
| 3,795,863 | 3/1974 | Umeda et al. | 340/815.03 |
| 3,813,664 | 5/1974 | Geyer | 340/815.03 |
| 3,873,979 | 3/1975 | Craford et al. | 340/815.03 |
| 4,298,869 | 11/1981 | Okuno | 340/815.03 |
| 4,388,589 | 6/1983 | Molldrem, Jr. | 340/815.03 |

*Primary Examiner*—Alvin Oberley
*Assistant Examiner*—M. Fatahiyar
*Attorney, Agent, or Firm*—Pearne, Gordon, McCoy & Granger

[57] ABSTRACT

A vertical storage and retrieval system has a light bar at the operator's station that visually indicates selected bins on a conveyor shelf. The light bar comprises an elongated rectangular tubing flush with the work surface. Several identical electric modules are connected end-to-end and inserted into the tubing. Each module has an array of parallel circuits, each containing a light emitting diode, connected to an electric source. Through circuits connect the terminal circuit of each array of parallel circuits to an electrical sink. A branch circuit of each parallel circuit connects with the corresponding parallel circuit on the adjacent module. The circuits are arranged such that the end module remote from the electric source and sink may be severed and a portion of the module discarded without affecting the operation of the light bar.

5 Claims, 2 Drawing Sheets

LIGHT BAR

The present application is a division of U.S. patent application Ser. No. 931,184, filed on Nov. 17, 1986, now U.S. Pat. No. 4,810,044.

BACKGROUND OF THE INVENTION

1. Field of the Invention

This invention pertains to storage apparatus, and more particularly to automated equipment for storing and retrieving parts.

2. Description of the Prior Art

Various equipment has been developed to minimize part storage space in factories and warehouses. For example, vertical storage and retrieval systems are known. Such systems comprise mechanized circulating shelves mounted like a vertical conveyor on a continuous lift principle. Such equipment enables the entire contents of the system to be stocked, retrieved, and restocked from a single access point.

Vertical storage and retrieval systems typically include a heavy frame that supports the conveyor chains and attached circulating shelves. The horizontal shelves are fit with bins, compartments, or dividers that are suited to hold the particular parts and assemblies to be stored. A vertical storage system may be over eight feet wide, so large numbers of different sized bins for holding small parts may be required on the shelves. Automatic controls record the storage location of the various parts. Upon command, the control operates the system to present the conveyor shelf holding a selected part to the access point for loading or unloading by a worker.

Because a conveyor shelf typically holds numerous bins, an indicator means is often included in the vertical storage and retrieval system to point out the specific bin on the shelf pertinent to the part being stored or retrieved. Prior indicator means include a series of incandescent bulbs arranged in a horizontal row at the operator's station. Separate wires are routed to each bulb. Such a design is difficult and time consuming to assemble. The incandescent bulbs have an undesirably short service life, and the bulbs and wires require excessive space. Further, the entire design is not sufficiently flexible to suit varying width vertical storage systems and bin sizes without costly custom designing each application.

SUMMARY OF THE INVENTION

In accordance with the present invention, an inexpensive and versatile light bar is provided that reliably indicates the particular bin of a vertical storage and retrieval system conveyor shelf that contains selected parts. This is accomplished by apparatus that includes an elongated housing in which are mounted a number of electric modules extending the width of the particular vertical storage system.

The housing may be in the form of a tubing having a length approximately equal to the length of the conveyor shelves. The tubing, which preferably is rectangular, is installed at the system operating station such that the tubing top surface lies flush with the work surface.

The electric modules comprise printed circuit boards approximately sixteen inches long. Each printed circuit board contains a number of light emitting diodes (LED) that protrude upwardly from the circuit board. The LEDs are spaced approximately one inch apart. The tubing is sized to receive the circuit boards, which are slid into the tubing from the ends. The modules have connectors on each end, so that adjacent modules are mechanically and electrically connectable endwise. To permit viewing the LEDs by the worker at his station, appropriate openings are cut into the housing top wall.

The versatility of the present invention is demonstrated by the fact that the tubing may be extruded in lengths greater than the longest anticipated conveyor shelf, and then cut to suit the particular shelf on which it is to be used. Further, as many electric modules as necessary may be assembled into the tubular housing. The last circuit board within the housing is severable to suit the housing length without affecting light bar operation. In that way, one size tubing and one design circuit board are sufficient for all vertical storage systems, and only one tubing size and one module design need be manufactured and stocked.

The printed circuit boards of the present invention are designed with a separate parallel circuit for each LED. Each parallel circuit includes a connector that is connectable to a source board. Although the boards are connectable end-to-end in series, all the LED circuits are connected electrically in parallel. The parallel circuits in each board join to a terminal circuit on that board that is connectable to a sink board activated by the system control. The control logic can light any combination of LEDs in the various boards by energizing the source board connector corresponding to a particular LED circuit plus the sink connector corresponding to the particular board. Severing the last board to suit the housing length removes the end circuits remote from the source board without affecting the remaining circuits on the boards or the system operation.

Other objects, aims and advantages will become apparent to those skilled in the art upon reading the detailed disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
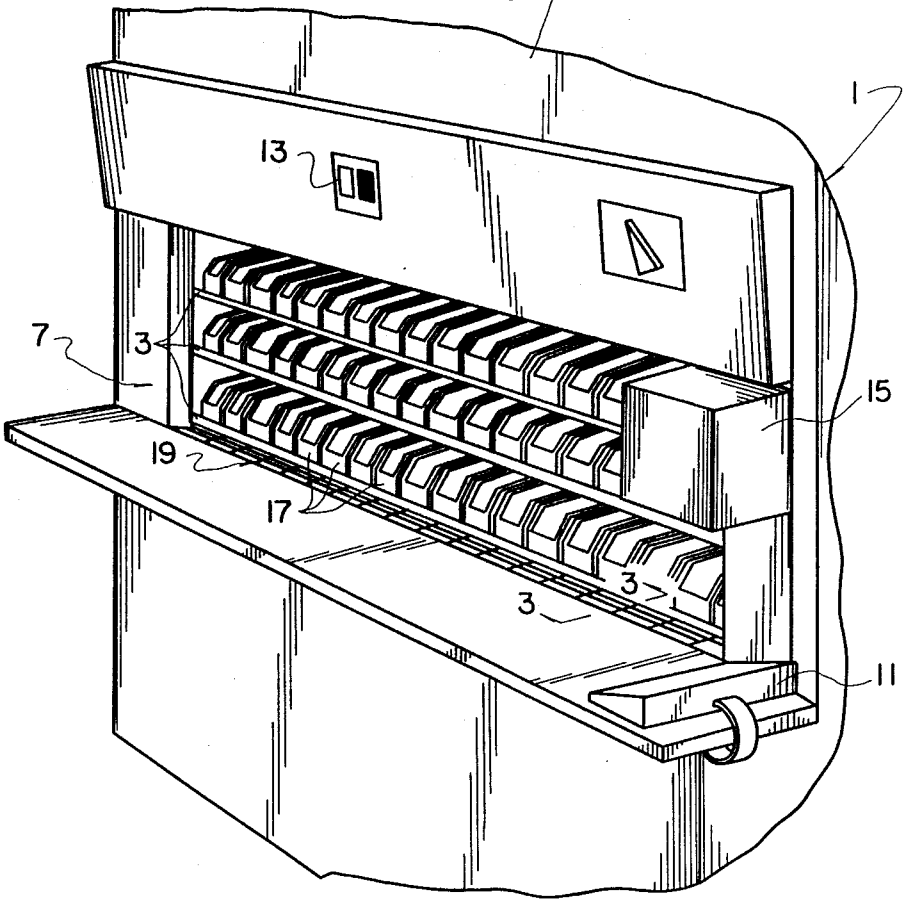
FIG. 2 is an enlarged perspective view of the vertical storage and retrieval system of FIG. 1 showing the light bar of the present invention installed at the operator's station.
Figure 1:
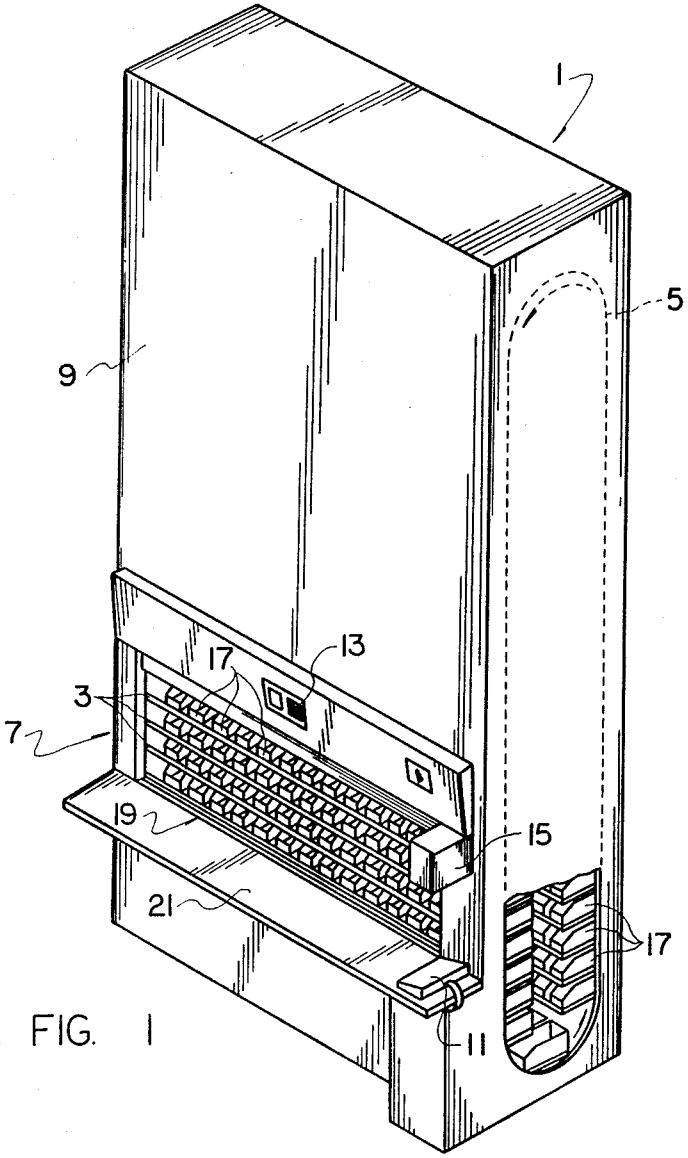
FIG. 1 is a perspective view of a vertical storage and retrieval system that includes the present invention.

Referring to FIGS. 1 and 2, a vertical storage and retrieval system 1 is illustrated that includes the present invention. The storage and retrieval system is particularly useful to maximize space utilization through high density vertical storage of individual parts and assemblies. However, it will be understood that the invention is not limited to part storage applications.

The vertical storage and retrieval system 1 includes a sturdy frame, not shown in FIGS. 1 and 2, that carry a plurality of horizontal shelves 3. The shelves 3 are connected at their ends to a pair of chains that are supported and driven by suitable sprockets, as is known in the art. The shelves circulate, as indicated by arrow 5, in a generally vertical plane. For security and safety purposes, the shelves, except at an operator's station 7, are enclosed in metal panelling 9. Sliding panels or doors may be used to close the operator's station 7. Automatic controls operated from a keyboard 11 or panel mounted station 13 direct the drive system to present a selected shelf to the operator's station for loading or unloading. A cathode ray tube screen 15 displays pertinent information regarding the storage and retrieval functions.

To hold the parts on the shelves 3, each shelf is provided with a number of bins 17. The bins may be of any size and shape for suitably holding the respective parts and assemblies to be stored. Since the vertical storage and retrieval system 1 may be over eight feet wide, a large number of bins are often fit on a shelf.

Figure 3:
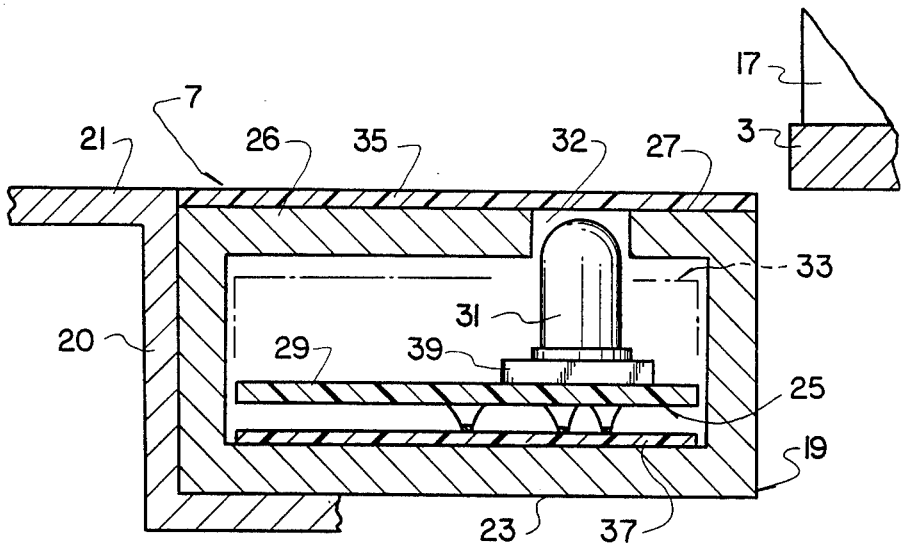
FIG. 3 is an enlarged cross-sectional view taken along lines 3—3 of FIG. 2.

In accordance with the present invention, a light bar 19 is built into the vertical storage and retrieval system 1. The light bar 19 quickly indicates to a worker the specific bin 17 on a shelf 3 that is to be loaded or unloaded. Referring to FIG. 3, the light bar 19 is supported by the system frame 20 at the operator's station 7. The light bar is designed to nest within the work surface 21 adjacent the front edge of a shelf 3 stopped at the operator's station 7.

In the preferred embodiment, the light bar 19 comprises an elongated housing 23 and a series of electric modules 25. The housing 23 is preferably a rectangular tubing 23. The tubing 23 may be of aluminum and extruded in long lengths. The tubing 23 is then cut to a length approximately equal to the length of the conveyor shelf 3 exposed at the work surface 21. The tubing top surface 27 is approximately flush with the work surface 21.

Each electric module 25 comprises a printed circuit board 29 containing a plurality of light emitting diodes (LEDs) 31. The module printed circuit boards 29 are preferably about 16 inches, long and the LEDs 31 are spaced approximately 1 inch apart longitudinally along the boards 29. Thus, there are sixteen LEDs 31 per module 25. A board width of approximately 1.2 inches and a thickness of approximately 0.06 inches has been found to be satisfactory.

The modules 25 are installed in the tubing 23 from the tubing ends. To permit a worker to view the LEDs 31 inside the tubing 23, the tubing top wall 26 is formed with one or more openings 32. Preferably, the opening 32 is a long slot, as that design permits the LEDs 31 to be placed as close as practical to the tubing top surface 27 and the work surface 21. Alternatively, a number of individual openings corresponding to the number of LEDs 31 may be formed in the tubing top wall 26. To protect the modules 25 inside the tubing 23, the tubing top surface 27 is covered with a thin transparent cover 35. The cover 35 may be a polycarbonate plastic sheet approximately 0.03 inches thick. In FIG. 3, the thickness of the plastic cover 35 is exaggerated for clarity. To insulate the modules 25 from the tubing 23, an insulating sheet 37 approximately 0.03 inches thick is interposed between the printed circuit boards 29 and the tubing 23. A nylon washer 39 is used in combination with each LED 31.

Figure 4:
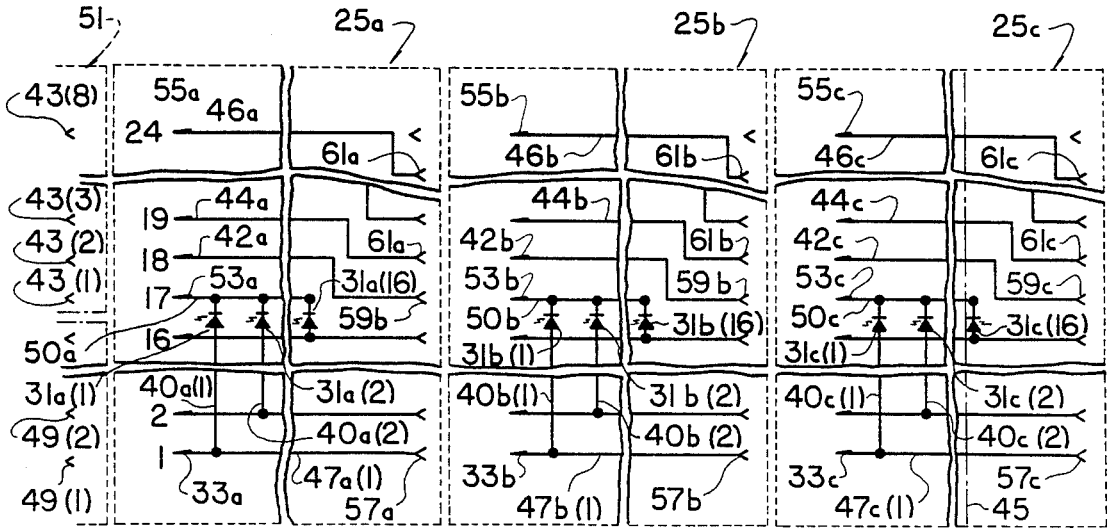
FIG. 4 is a simplified electrical schematic diagram of the circuitry of the electric module of the present invention.

As many modules 25 as are required to fill the tubing 23 are used. Adjacent modules 25 are connected end-to-end in mechanical series by electrical connectors 33. Referring to FIG. 4, three modules **25*a*, 25*b*, and 25*c* are shown in endwise juxtaposition. It will be appreciated, of course, that a larger number of modules 25 may be required to fill a tubing 23. The conveyor shelf 3** and tubing lengths need not be in multiples of 16 inches. Excess module length is easily accommodated, as will be explained presently.

For simplicity, only three LEDs 31 and associated circuit board circuits are illustrated in FIG. 4 for each module 25, as the principle of the present invention can be adequately explained without a detailed description of all sixteen LED circuits. Each module contains a number of circuits 40 that are in parallel with each other. An LED 31 is in each respective parallel circuit 40. For example, in module **25*a*, there is a circuit 40*a*(1) having LED 31*a*(1), and circuit 40*a*(2) includes an LED 31*a*(2). A connector 33 is required for each parallel circuit 40 and associated LED 31. Each parallel circuit 40 joins to a terminal circuit 50 that connects with all the parallel circuits 40 of a module 25. Each terminal circuit 50 has an end connector 53. Thus, in module 25*a*, each parallel circuit 40*a* defines a path that begins at the respective connector 33*a* and includes an LED 31*a*, continues through the terminal circuit 50*a*, and ends at the connector 53*a***.

Each module circuit board 25 also contains a number of through circuits 42, 44, and 46. Any number of circuits 42, 44, and 46 may be used, depending on the maximum number of modules required for a particular light bar 19. The through circuits have end connectors 55.

Each parallel circuit 40 has a corresponding branch circuit 47 that terminates in a connector 57. Each connector 57 is adapted to mate with a connector 33 that corresponds to the parallel circuit 40 of the adjacent module 25.

The first module, module **25*a*, is electrically connected to a source board 41 having connectors 49 that mate with the corresponding connectors 33*a* of the module parallel circuits 40*a*. Simultaneously, terminal circuit connector 53*a* and through circuit connectors 55*a* connect with corresponding connectors 43 of a sink board 51. Module 25*b* is connected to module 25*a*, and module 25*c*, which is the last module in FIG. 4, is connected to module 25*b*. End connecting the module 25*b* to module 25*a* connects the parallel circuits 40*b* to the circuits 40*a* by means of the branch circuits 47*a* and the connectors 33*b* and 57*a*. At the same time, terminal circuit 50*b* connects with through circuit 42*a* by means of connectors 53*b* and 59*a*. Through circuit connects with through circuit 42*b* by means of connectors 61*a* and 55*b*. Similar connections are made between modules 25*b* and 25*c*. Thus, by means of the branch circuits, the parallel circuits on modules 25*b* and 25*c* are connected to the source board 41. In that way, one source board connector 49 is sufficient to handle all the corresponding parallel circuits 40 and LEDs 31 on the modules 25. For example, connector 49(1) on the source board is used to energize the circuits 40*a*(1), 40*b*(1), and 40*c*(1) on modules 25*a*, 25*b*, and 25*c*, respectively. Similarly, by means of through circuits 44*a* and 42*b*, terminal circuit 50*c* is connected to the sink board 51**.

In most applications, the total length of the modules 25 exceeds the length of the tubing 23 for a particular vertical storage and retrieval system 1. In those applications, the end module 25c is merely severed to the correct length to fit the tubing 23. The higher number parallel circuits 40, that is, the circuits on the right side of the module 25c as viewed with respect to FIG. 4, are discarded. For example, the circuit board of module 25c may be cut along phantom line 45. Module 25c would then have only 15 LEDs and associated parallel circuits. Because of the unique design of the circuit boards of the present invention, cutting and discarding a portion of the last board has no effect on the operation of the light bar 19 when installed in the storage system 1.

In operation, it will be assumed that it is desired to indicate bins 17 on a conveyor shelf 3 that are proximate LED 31a(1) in module 25a and LED 31c(2) in module 25c. In that case, the vertical storage and retrieval system control logic operates to energize source board connectors 49(1) and 49(2), and sink board connectors 43(1) and 43(3). Energizing source board connector 49(1) and sink board connector 43(1) completes a path through LED 31a(1). Energizing source board connector 49(2) and sink board connector 43(3) completes a path through LED 31c(2). In a similar manner, any combination of LEDs can be energized to quickly direct the worker's attention to the one or more bins on a shelf 3 that pertain to the parts he is working with. The one inch spacing of the LEDs 31 along the light bar 19 permits great flexibility for lighting the LEDs 31 adjacent the various bins 17 on the conveyor shelves 3. The fact that the end module 25, as, for example, module 25c, is severed along line 45 has no effect on the operation of the remainder of that or any other module 25.

Thus, it is apparent that there has been provided, in accordance with the present invention, a light bar that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall with the spirit and broad scope of the appended claims.

I claim:

1. A printed circuit board comprising:

a. a plurality of first circuits, each first circuit including a light emitting device and having a separate source connector;

b. a terminal circuit commonly joined to said first circuits and having a sink connector, whereby each first circuit extends between said sink connector and a separate one of said source connectors;

c. a branch circuit extending from each source connector and terminating in a further connector; and d. at least one first and second connector on said printed circuit board, and a conductor extending between said first and second connectors, said second connector having the same position with respect to said further connectors that said sink connector has with respect to said source connectors, to enable external connections to said printed circuit board, whereby said light emitting devices may be energized by the application of a voltage between said sink connector and the source connector to which the corresponding first circuit is connected.

2. The printed circuit board of claim 1 wherein said light emitting devices comprise light emitting diodes.

3. The printed circuit board of claim 1 wherein the source connectors and the terminal circuit connector and the first connector are located on one end of the printed circuit board, and wherein the branch circuit and second connectors are located on an end of said printed circuit board opposite said one end thereof, so that a plurality of identical said printed circuit boards may be connected end-to-end with their light emitting devices selectively energized via the terminal connector and a first connector on one of said printed circuit boards.

4. The printed circuit board of claim 3 wherein the terminal connector of a second printed circuit board is connected to the second connector of a first printed circuit board, whereby the light emitting devices of said second printed circuit board may be energized by the application of a voltage between said first connector and said source connectors of said first printed circuit board.

5. The printed circuit board of claim 4 wherein the first, terminal, and branch circuits are arranged such that a portion of the board including at least one light emitting device may be severed and discarded without inhibiting the energization of light emitting devices remaining on said board.

* * * * *